United States Patent [19]

Poppe

[11] Patent Number: 4,895,136

[45] Date of Patent: Jan. 23, 1990

[54] HIGH-TEMPERATURE HEATERS, METHODS AND APPARATUS

[75] Inventor: Dean A. Poppe, St. Petersburg, Fla.

[73] Assignee: Kemco Systems, Inc., St. Petersburg, Fla.

[21] Appl. No.: 240,007

[22] Filed: Sep. 2, 1988

[51] Int. Cl.[4] ..... F24H 1/10

[52] U.S. Cl. ..... 126/355; 126/359; 126/362; 122/367 C; 122/451 R; 122/486; 122/489

[58] Field of Search ..... 126/359, 360 R, 360 A, 126/355, 350 R, 361, 373, 375, 376, 362; 122/489, 367 PF, 367 C, 20 A, 451 R, 486, 492, 214; 165/145, 172, 170, 176; 261/98, 94, DIG. 72

[56] References Cited

U.S. PATENT DOCUMENTS

| | | | |
|---|---|---|---|
| 3,165,092 | 1/1965 | Chadwick et al. | 122/214 |
| 3,692,017 | 9/1972 | Glachant | 126/360 A |
| 4,449,485 | 5/1984 | Tan | 122/214 |

FOREIGN PATENT DOCUMENTS

| | | | |
|---|---|---|---|
| 143537 | 10/1961 | U.S.S.R. | 126/355 |

*Primary Examiner*—James C. Yeung

*Attorney, Agent, or Firm*—Dominik, Stein, Saccocio, Reese, Colitz & Van Der Wall

[57] ABSTRACT

An improved gas-jet hot water heater system for the generation of high-temperature water at atmospheric pressure simultaneously with superheated water and/or steam. The heater system comprises a primary tank for the generation and storage of high-temperature water. The primary tank includes a combustion zone whereat the products of combustion of a gas-jet burner may heat the water passing therethrough and a storage zone located beneath the combustion zone for receipt and storage of the heated water. A supplemental sub-assembly includes a pressurized remote storage tank, a heat exchanger in the combustion zone for water to being superheated by the products of combustion of the gas-jet burner and conduit means coupling the heat exchanger with the storage tank. The heat exchanger will create and store superheated water in the lower extent of the storage tank and steam in its upper extent. In an alternate embodiment, the output of the heat exchanger may be fed remotely for direct use.

14 Claims, 9 Drawing Sheets

FIG. 4
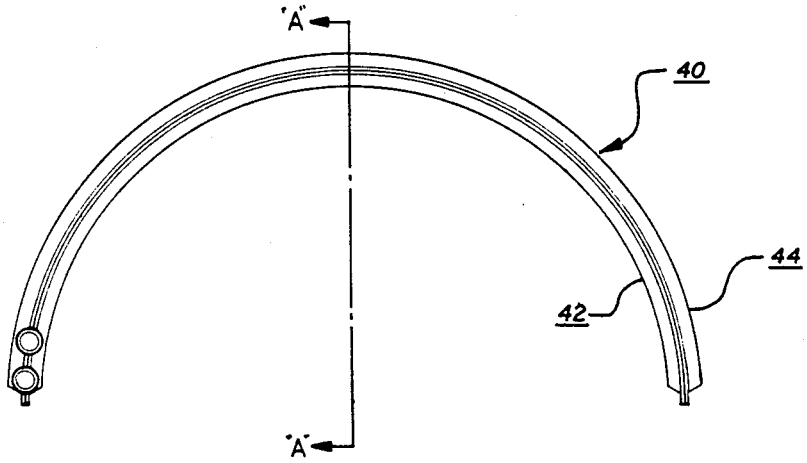
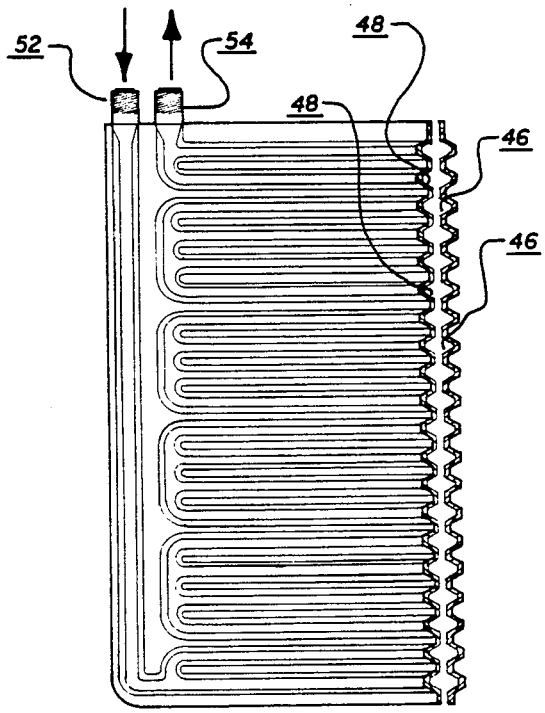
FIG. 5

HIGH-TEMPERATURE HEATERS, METHODS AND APPARATUS

BACKGROUND OF THE INVENTION

This invention relates to methods and apparatus for high-temperature heating and, more particularly, to gas-jet heater systems for the generation of high temperature water simultaneously with the generation of superheated water and/or steam.

DESCRIPTION OF THE BACKGROUND ART

A recent advance in high-quality, high-efficiency gas-jet hot water heaters is described in U.S. Pat. No. 4,275,708 to Wood and assigned to the assignee of the instant application. According to that disclosure a hot water heater is divided into three (3) vertically disposed zones. The incoming water is evenly distributed into the heater from above through the upper most or preheat zone. The preheat zone includes an internal design which provides for an initial preheating of the incoming water. The preheated water then falls from the heat transfer zone into a combustion zone. In the combustion zone, the water comes into operative association with the products of combustion of a gas-jet burner. The heating of the water is thus completed whereafter the heated water falls into the lower most or hot water storage zone at the bottom of the tank. The heated water collected and stored at the bottom of the tank and then may be pumped when needed. Only a minimum of storage is usually required to maintain a constant, regulated supply of hot water at the desired high temperature.

According to the design of the hot water heater of the aforementioned patent, the system operates at atmospheric pressure. When passing through the upper heat transfer zone, the water comes into direct contact with the thermal output of the gas-jet burner. This reduces the temperature of the exhaust gasses to less than or equal to the ambient temperature thereby eliminating stack losses. The design raises the previous thermal efficiencies of about eighty (80) percent or less to efficiencies of nearly one-hundred (100) percent.

Another feature of the water heater of the aforementioned patent involves the use of a plurality of heat absorbing bodies in the heat transfer zone which act as heat exchangers and also for oxygen stripping. A forced drought associated with the gas-jet burner allows the combustion products to rise through the heat absorbing bodies at a rate which heats the water and strips off most of the dissolved oxygen. The incoming water is introduced into the furnace through a spray in the upper compartment and the combustion products are vented through a flue so as to prevent the back-flow of air when the furnace burner is shut off. This maintaining an oxygen free atmosphere in the unit. The system thus produces a non-corrosive water, which may be of drinking quality, in a heating system which will have a negligible corrosive effect on any copper or steel pipes utilized in the system and which thus abates corrosion problems normally associated with carbon dioxide, nitrogen dioxide, sulphur dioxide, etc.

One of the deficiencies of hot water heaters of advance designs involves the fact that they generate hot water at the single temperature. Efforts are continuously being made to utilize a single system as a conventional source of hot water at less than the boiling temperature of two-hundred-twelve (212) degrees Fahrenheit as well as a source of superheated water and/or steam.

For example, in U.S. Pat. No. 1,958,736 to Barrow, there is disclosed a hot water system including supplemental tanks for additional heating of a supplemental quantity of water. A burner is located in the lower or reservoir segment of the basic hot water heater. In U.S. Pat. No. 1,768,971 to Beaucage and U.S. Pat. No. 1,538,436 to Kohlmeyer supplemental heating devices found as coils within a hot water heater are disclosed. In Beaucage, the burner is located below the hot water heater while in Kohlmeyer the heat for raising the water temperature is done through a fire box with solid fuel. These patents do, however, disclose combination structures for generating water and steam. In U.S. Pat. No. 4,557,323 to Hardy, there is disclosed a heat exchanger with coils which are directly heated by gas furnace flames from below as is U.S. Pat. No. 4,669,091 to Waters.

A wide variety of other hot water heater arrangements and components having limited degrees of similarities to the presently disclosed invention can be found by reference to U.S. Pat. No. 2,985,149 to Mauro; 3,336,910 to Taylor; 4,175,518 to Reames; 4,373,473 to Grandmont; 4,374,506 to Whalen; 4,412,652 to Voss; 4,541,410 to Jatana; 4,556,104 to Engelhardt. All of these references disclose water heaters which include heat exchanger elements which are heated by flue gasses. However, the heated coils are not used for generating steam and/or superheated water.

Further arrangements of hot water heater components and heat exchangers are shown in U.S. Pat. No. 1,865,852 to Goldhagen; 4,090,474 to Kauffmann; 4,621,592 to McInerney and 4,641,631 to Jatana.

As illustrated by the great number of prior patents and commercial devices, efforts are continuously being made in an attempt to improve hot water heaters for generating heated water at atmospheric pressures simultaneously with the generation of high temperature, high pressure steam and/or superheated water. None of these previous methods, however, provides the benefits attendant with the present invention. Additionally, prior practices and literature do not suggest the present inventive combination of method steps and component elements arranged and configured as disclosed herein. The present invention achieves its purposes, objects and advantages over the prior art devices through a new, useful and unobvious combination of component elements, with the use of a minimum number of functioning parts at a reasonable cost to manufacture, and by employing only readily available materials.

It is, therefore, an object of the present invention to provide an improved gas-jet hot water heater system for the generation of high-temperature water at atmospheric pressure simultaneous with superheated water and/or steam comprising a primary tank for the generation and storage of high-temperature water at atmospheric pressure the tank including an upper preheat zone containing heat transfer bodies therein through which water to be heated may pass, an intermediate combustion zone located beneath the preheat zone where the products of combustion of a gas-jet burner may heat the water passing therethrough, and a storage zone located beneath the combustion zone for receipt of the heated water passing through the combustion zone; and a supplemental water-heating sub-assembly including a pressurized remote storage tank, a heat exchanger in the combustion zone for water being heated by the products of combustion of the gas-jet burner and conduit means coupling the heat exchanger with the remote storage tank whereby the heat exchanger will create superheated water and the remote storage tank will store the superheated water in its lower extent and steam will be created in its upper extent.

It is a further object of the invention to provide an improved method of generating hot water at atmospheric pressure in a hot water heater simultaneously with the generation of superheated water and/or steam comprising the steps of providing a primary water heater for the generation of hot water at atmospheric pressure; providing a supplemental water heating sub-assembly with a heat exchanger; positioning the heat exchanger in the primary tank for being heated by a gas-jet burner; and coupling the heat exchanger in a system whereby water superheated in the heat exchanger may be fed for use as superheated water and/or steam.

It is another object of this invention to generate high temperature water at atmospheric pressure concurrently with superheated water and/or steam.

It is a further object of the invention to utilize a common source of thermal energy to generate hot water simultaneously with superheated water and/or steam.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an improved gas-jet hot water heater system for the generation of high-temperature water at atmospheric pressure simultaneous with superheated water and/or steam comprising: a primary tank for the generation and storage of high-temperature water at atmospheric pressure including an upper preheat zone containing heat transfer bodies therein through which water to be heated may pass, an intermediate combustion zone located immediately beneath the preheat zone where the products of combustion of a gas-jet burner may heat the water passing therethrough, and a storage zone located beneath the combustion zone for receipt of the heated water passing through the combustion zone; and a supplemental water-heating sub-assembly including a pressurized remote storage tank, a heat exchanger in the combustion zone for water being heated by the products of combustion of the gas-jet burner, and conduit means coupling the heat exchanger with the remote storage tank whereby the heat exchanger will create superheated water and the remote storage tank will store the superheated water in its lower extent and create steam in its upper extent.

The heat exchanger is located in the combustion zone, on the side thereof remote from the gas-jet burner. The flame of the gas-jet burner may extend into the combustion zone in operative proximity with the heat exchanger, or in the alternative, the gas-jet burner may be recessed from the combustion zone so that its flame is withdrawn from the flow of water passing through the combustion zone whereby the heat exchanger is heated by the flue gasses which are heated by the gas-jet burner.

The invention may also be incorporated into an improved gas-jet hot water heater for the generation of heated water at atmospheric pressure simultaneously with superheated water and/or steam comprising a vessel for the generation and storage of heated water at atmospheric pressure, the vessel having a combustion zone whereat the thermal output of a gas-jet burner may heat water passing therethrough and a reservoir for the receipt and storage of the heater water; a heat exchanger in the combustion zone for circulating water to be superheated by the thermal output of the gas-jet burner; and conduit means coupled to the heat exchanger for remote usage of the circulating superheated water as superheated water and/or as steam.

The heat exchanger is located on the side of the combustion zone remote from the gas-jet burner. The flame of the gas-jet burner may extend into the combustion zone in operative proximity with the heat exchanger, or in the alternative, the gas-jet burner may be recessed from the combustion zone so that its flame is withdrawn from the flow of water through the combustion zone whereby the heat exchanger is heated by the flue gasses heated by the gas-jet burner. The heat exchanger is a pad formed in a semi-circular configuration with a serpentine path of travel for water moving therethrough. The pad is formed of facing sheets of metal with deformed areas mated to define the serpentine path. The apparatus further includes a pressurized supplemental vessel for the receipt and storage of superheated water from the heat exchanger in the lower portion thereof and for the storage of steam in the upper portion thereof. The apparatus further includes means to provide make up water to the supplemental vessel from the reservoir. The means to provide make up water to the supplemental vessel is from a remote source. The flame of the gas-jet burner may be directed toward the combustion zone, perpendicularly with respect to the direction of movement of water through the combustion zone, or in the alternative, the flame of the gas-jet burner may be directed toward the combustion zone, at an angle with respect to the direction of movement of water through the combustion zone.

Lastly, the invention may further be incorporated in a method of generating hot water at atmospheric pressure in a hot water heater simultaneously with the generation of superheated water and/or steam comprising the steps of providing a primary water heater for the generation of hot water at atmospheric pressure; providing a supplemental water heating sub-assembly with a heat exchanger; positioning the heat exchanger in the primary tank for being heated by a gas-jet burner of the primary water heater; and coupling the heat exchanger in a system whereby water, superheated in the heat exchanger, may be fed for use as super-heated water and/or steam.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiments may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIG. 4 is an elevational view of the heat exchanger shown in FIGS. 2 and 3.

FIG. 5 is a sectional view of the heat exchanger shown in FIG. 4 taken along line A—A of FIG. 4.

Similar referenced characters refer to similar parts throughout the several Figures.

DETAILED DESCRIPTION OF THE INVENTION

Figure 1:
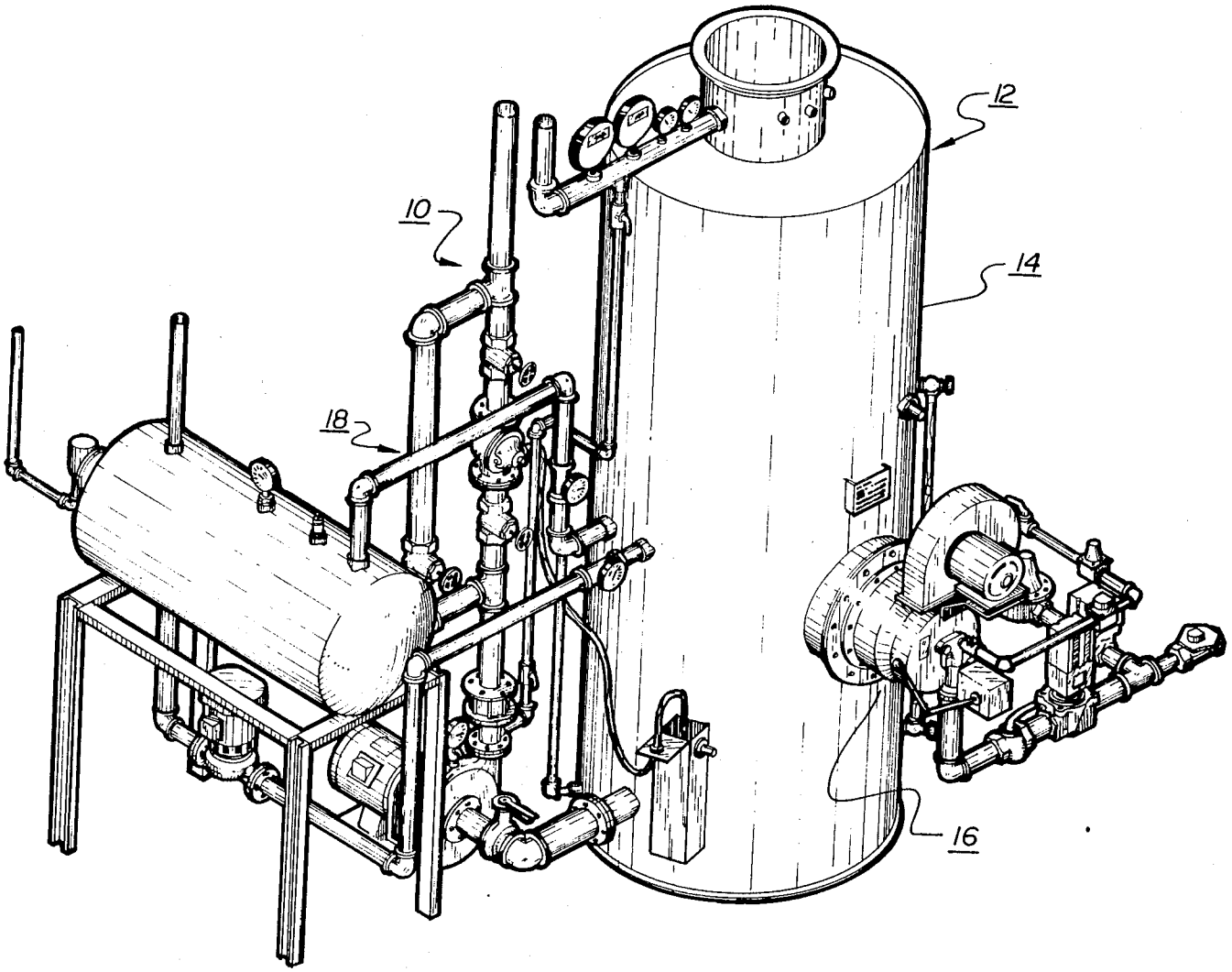
FIG. 1 is a perspective illustration of the gas-jet heater system constructed in accordance with the principles of the present invention.
Figure 2:
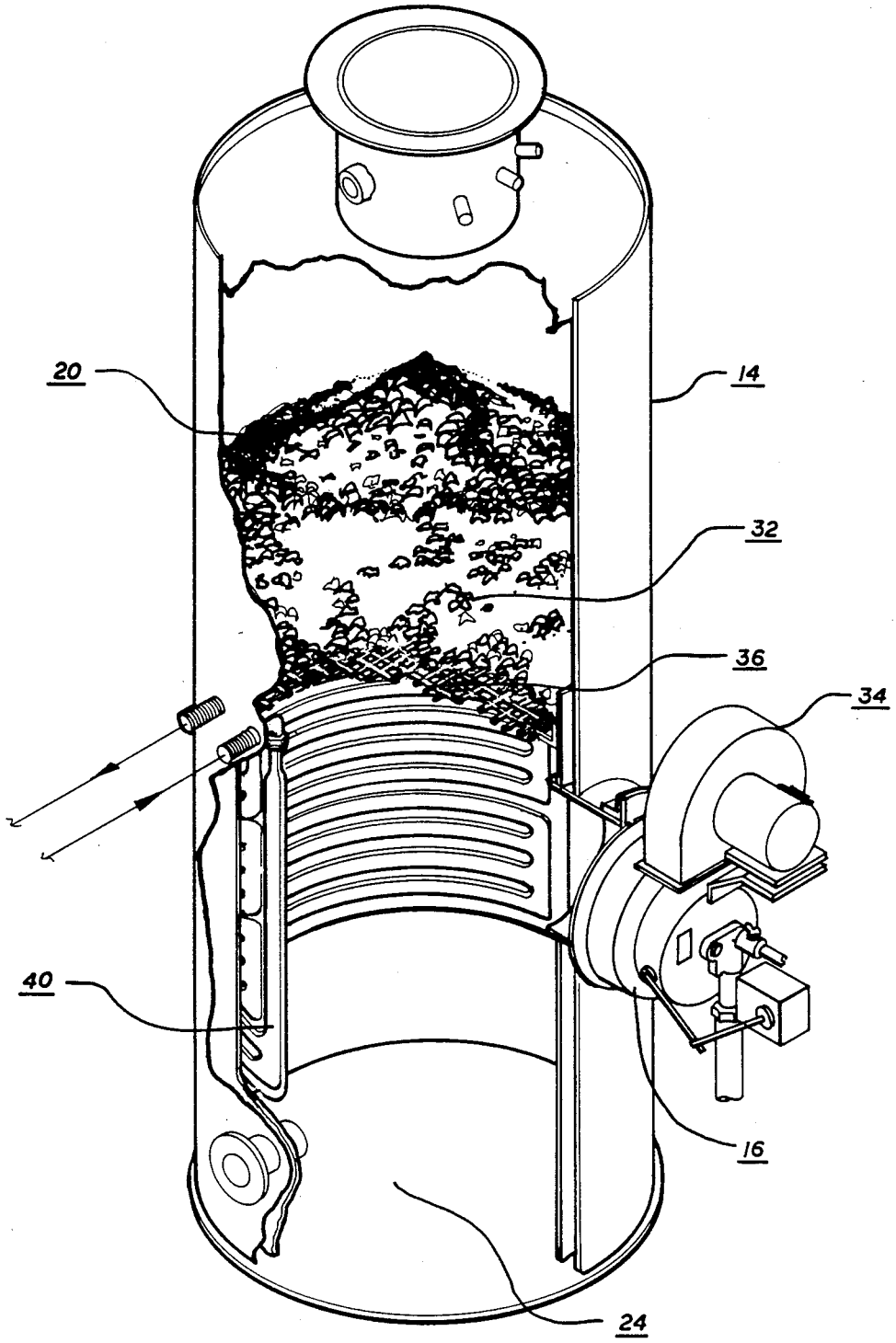
FIG. 2 is a perspective illustration of the gas-jet heater shown in FIG. 1 with parts broken away to show certain internal construction.

With reference to FIG. 1, there is shown a gas-jet hot water heater system 10 constructed in accordance with the principles of the present invention. The principle component of the system 10 is the hot water heater 12 having a vessel or tank 14 with burner 16 and plumbing 18 generally as described in U.S. Pat. No. 4,275,708 to Wood. According to that disclosure, the tank 14 is divided into three (3) vertically disposed zones; an upper most preheat zone 20, an intermediate combustion zone 22 and a reservoir or lower most water storage zone 24.

The incoming water is evenly distributed into the tank 14 from above through a manifold 28 into the upper most or preheat zone 20. The preheat zone includes an internal design which provides for an initial preheating and heat transfer of the incoming water prior to the water entering the intermediate or combustion zone 22.

Figure 3:
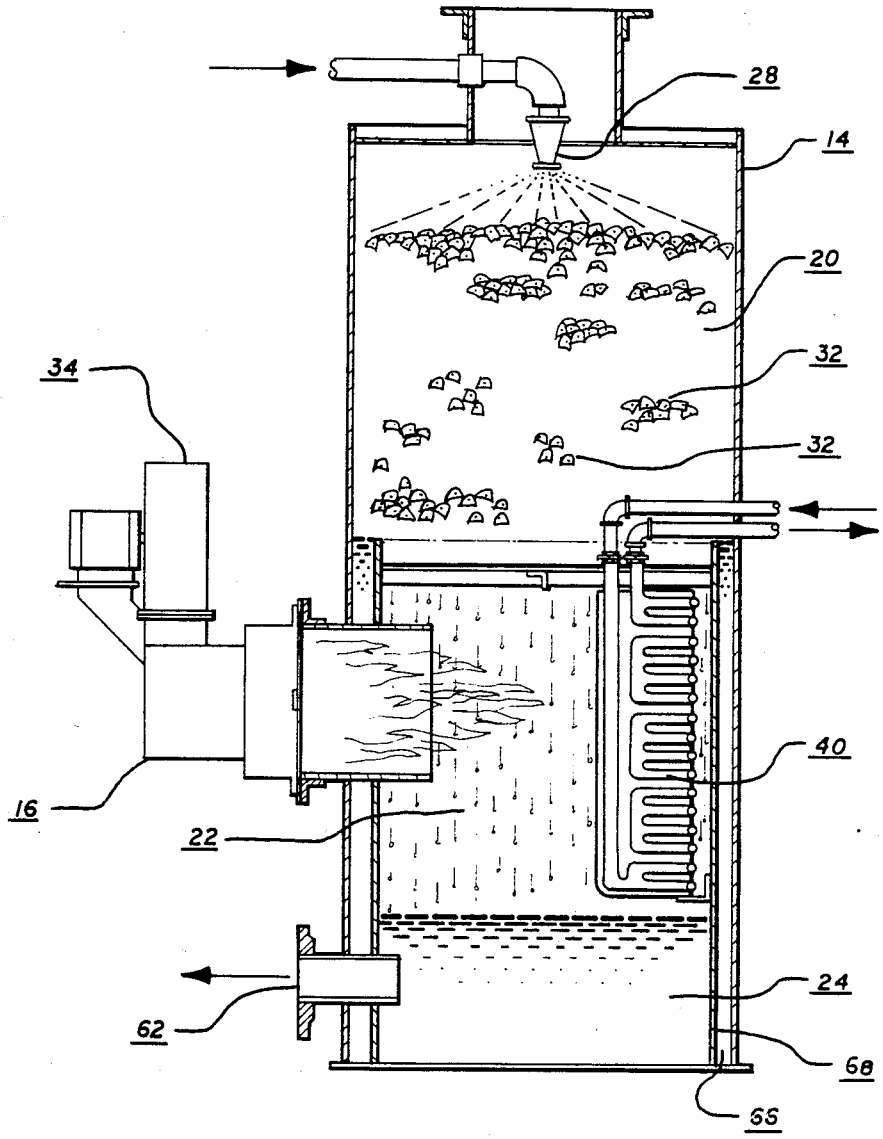
FIG. 3 is an sectional view of the gas-jet heater of FIGS. 2.

The preheated water of the preheat zone 20 then falls into the combustion zone 22. As the preheated water passes through the length of the combustion zone, it comes into thermal association with the thermal output of the gas-jet burner, shown in FIG. 3 as the flame. It may, in an alternate embodiment to be later described, pass through the flue gasses of the combustion chamber which are heated by the flame of the gas-jet. In either embodiment, it is the thermal output of the gas-jet, the products of the combustion, which heat the water. The heat transfer in this place takes place without any intermediate medium. The heat transfer and heating of the water is thus completed. The heated water then falls and settles in the lower most or hot water storage zone 24. The heated water collected at the bottom of the tank may subsequently be pumped otherwise used when needed. Only a minimum of storage is usually required to maintain a constant, regulated supply of hot water at the desired elevated temperature.

According to the design of the hot water heater 12, as in the aforementioned patent, the present hot water heater operates at atmospheric pressure. When passing through the upper heat transfer or preheat zone 20, the water comes into contact with the thermal output of the gas-jet burner. This reduces the temperature of the exhaust gasses to less than or equal to the ambient temperature thereby eliminating stack losses. The design raises the previous thermal efficiencies of about eighty (80) percent or less to efficiencies of nearly one-hundred (100) percent.

Another feature of the water heater of the aforementioned patent and the present invention involves the use of a plurality of heat absorbing bodies 32 in the heat transfer zone 20 which act collectively as a heat exchanger while the heat transfer zone 20 functions as an oxygen stripping chamber. The burner 16 is provided with a blower 34 which acts as a forced drought for the burner. Provided above the combustion zone 22 is a body supporting grid 36 for supporting the heat absorbing bodies 32. Its apertures allow the combustion products to rise through the bodies at a rate which heats the water and strips most of the dissolved oxygen from it.

The incoming water is preferably introduced into the tank through a manifold 28 as a spray above the upper zone 20. The combustion products are vented through a flue so as to prevent back-flow of air when the furnace burner is shut off. This arrangement maintains an oxygen free atmosphere in the unit. The system may thus produce a relatively non-corrosive water approaching drinking quality which will have negligible corrosive effect on, for example, any copper or steel pipes utilizing the system. As such, the system abates problems of corrosion normally arising from carbon dioxide, nitrogen dioxide, sulphur dioxide, etc., found in other systems.

In so far as the hot water heater 12 described hereinabove is concerned, such heater is commercially available from a Kemco System, Inc. of St. Petersburg, Florida as the Thermefficient-100 hot water heater. In addition to the hot water heater 12, the system 10 includes supplemental elements for supplemental functions. The principle supplemental element is the heat exchanger 40 along with its associated supplemental plumbing. The heat exchanger is formed as a semi-circular pad formed of two corrosion resistant plates 42 and 44, as of stainless steel, and oriented in face-to-face relationship. The plates are formed with mating protuberances 46 whereby, when secured in operative relationship with each other, they will define a serpentine-like path 48 for water passing therethrough from an inlet orifice 52 to an exit orifice 54.

Devices similar to the present heat exchanger are those commercially available and sold by the Tranter Company as heat exchangers. Such commercially available devices, however, are generally formed as a 360 degree circle with hot water passing therethrough for the purpose of heating a fluid within the confines of the circle. In contrast to the known use for such heat exchangers, the present heat exchanger is formed merely in a semi-circular configuration. It functions in association with a gas jet to heat water passing therethrough in the formation of superheated water and/or steam. Such heat exchanger is located in the combustion zone 22 of the hot water heater tank 14 opposite from the gas-jet burner 16. In this manner it is maintained in operative thermal proximity therewith.

Figure 6:
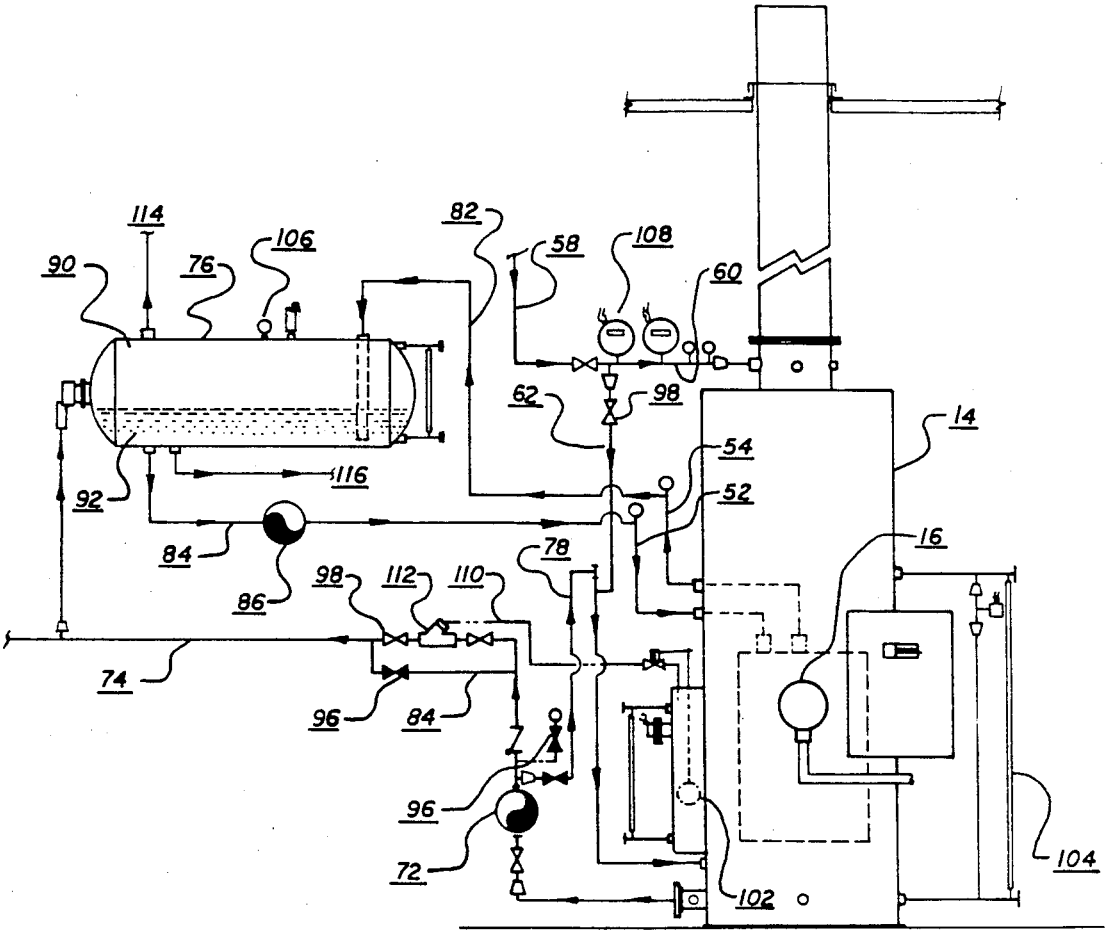
FIGS. 6, 7 and 8 are flow diagrams of the apparatus shown in FIG. 1 as well as two alternate embodiments thereof.

As can best been seen in FIGS. 1 and the diagrammatic showing of FIG. 6, water enters the system through an input line 58 supplying cold tap water. The plumbing associated with the hot water heater involves lines which split the input water into an upper portion of the hot water heater through line 60 and manifold 28 for falling through the upper most or preheat zone 20 then through the intermediate or combustion zone 22 and finally to the lower most storage zone or reservoir 24. An alternate path for the inlet water conveys such water through a line 62 to the lower part of the insulation jacket 66 of the hot water heater. Such jacket 66 includes a tank inner liner 68 for containing a flow of insulation water in the conventional manner. The water in the insulating jacket 66 moves upwardly for entering the intermediate zone 22 of the tank from above for being heated by the burner 16.

The output from the storage zone 24 of the tank may be moved by a pump 72 whereafter the heated water is split to follow a primary line 74 for make-up water into a supplemental storage vessel or tank 76. An additional flow of water therefrom passes through a line 78 where it is mixed with the incoming tap water for entry into the insulating jacket 66.

An additional line 82 associated with the system conveys the water from the heat exchanger 40 into the supplemental tank 76. A further line 84 employs a pump 86 to convey water from the supplemental tank 76 back into the heat exchanger 40. As can be understood, the upper portion 90 of the supplemental tank 76 constitutes a source of high pressure steam at from about 250 to 300 degrees Fahrenheit and at from about 15 to 50 pounds per square inch (psi) pressure. The lower portion 92 of the supplemental tank 76 constitutes a source of superheated water in addition to the hot water at atmospheric pressure within the primary main hot water heater 12. Manual valves 96, 98, etc. and, if needed, automatic valves are provided for maintenance purposes where needed.

On one side of the hot water heater in fluid communication with the fluid in the reservoir is a ball float 102 for regulating discharge pump 72. The float functions in the conventional manner. Safety device 104, also conventional, is on the opposite side of the hot water heater for sensing the water level in the jacket. Pressure gauges 106 and pressure switches 108 are appropriately placed throughout the system as needed for determining and monitoring appropriate flows.

A line 110 constitutes a feedback path from the flow of water from the storage zone 24. Line 110 is coupled with the float 102 for controlling hydraulic valve 112 for automatically maintaining an appropriate preset amount of water to the tank 14 as needed to preclude operation of the system 10 in a dry condition. Lines 114 and 116 with conventional valves are coupled to the upper and lower portions 90 and 92 of tank 76 to allow the selective removal of steam and superheated water for use as desired.

Figure 7:
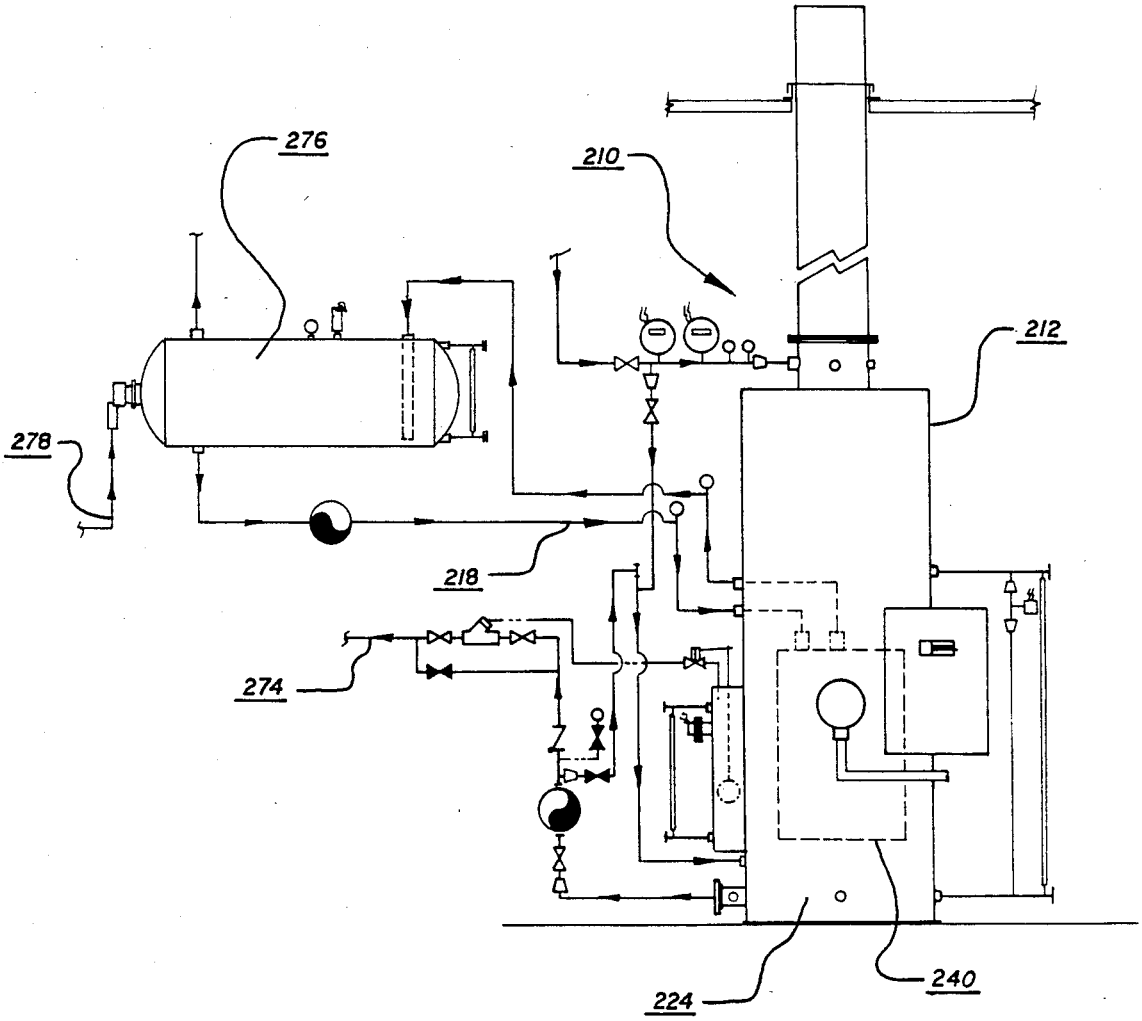

The diagrammatic showing of the hot water heater system 210 of FIG. 7 is essentially the same as that of FIG. 6. This alternate embodiment of the invention has a hot water heater 212, heat exchanger 240, plumbing 218, etc., as in the above described primary embodiment, except that line 274 from the water storage zone 224 extends directly to a remote location for use. As such, the water from the storage zone 224 does not feed back to the supplemental tank 276 for providing make up water. Rather, make up water enters the supplemental tank from the top through a direct line 278.

Figure 8:
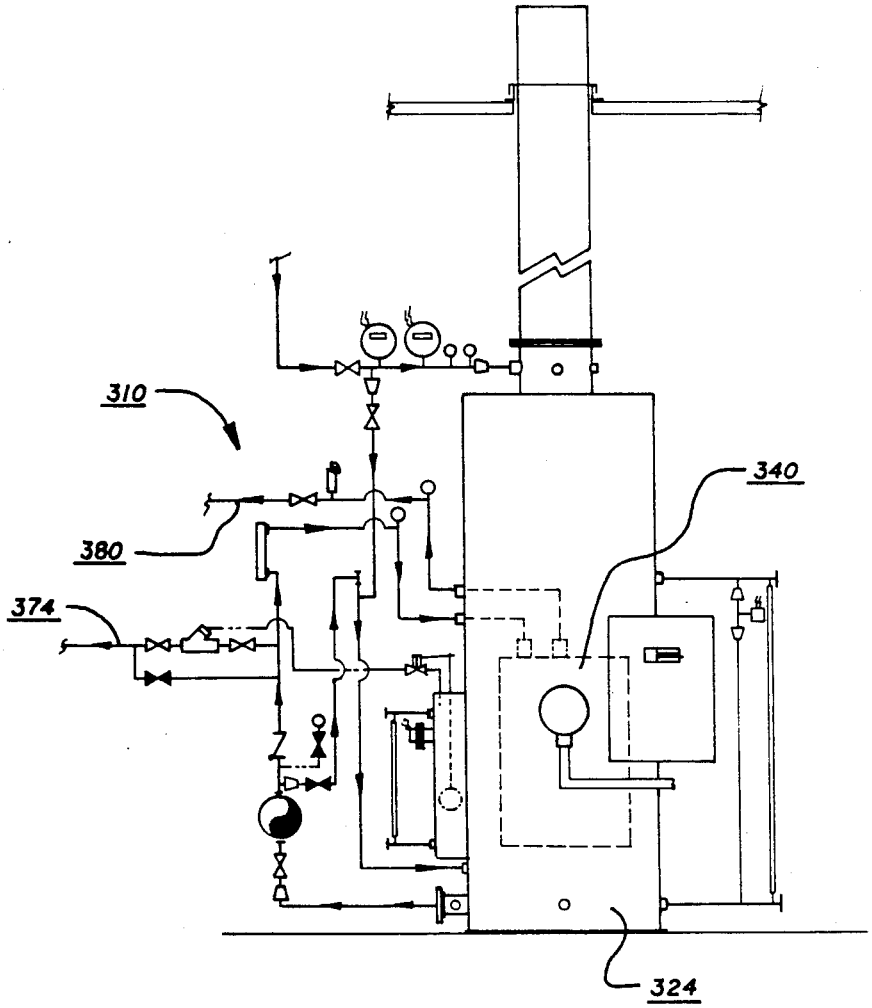

The diagrammatic showing of the system 310 of FIG. 8 also is essentially the same as that of FIG. 7 except that the supplemental storage tank is eliminated. The output from the water storage zone 324 is directly coupled with a line 374 for direct usage at a remote location as in the FIG. 7 embodiment. The superheated water, the output from the heat exchanger 340, however, is fed by line 380 directly to the user as superheated water or steam, depending on the pressure of the region of use. This finds utility as boiler make-up water or the like.

Figure 9:
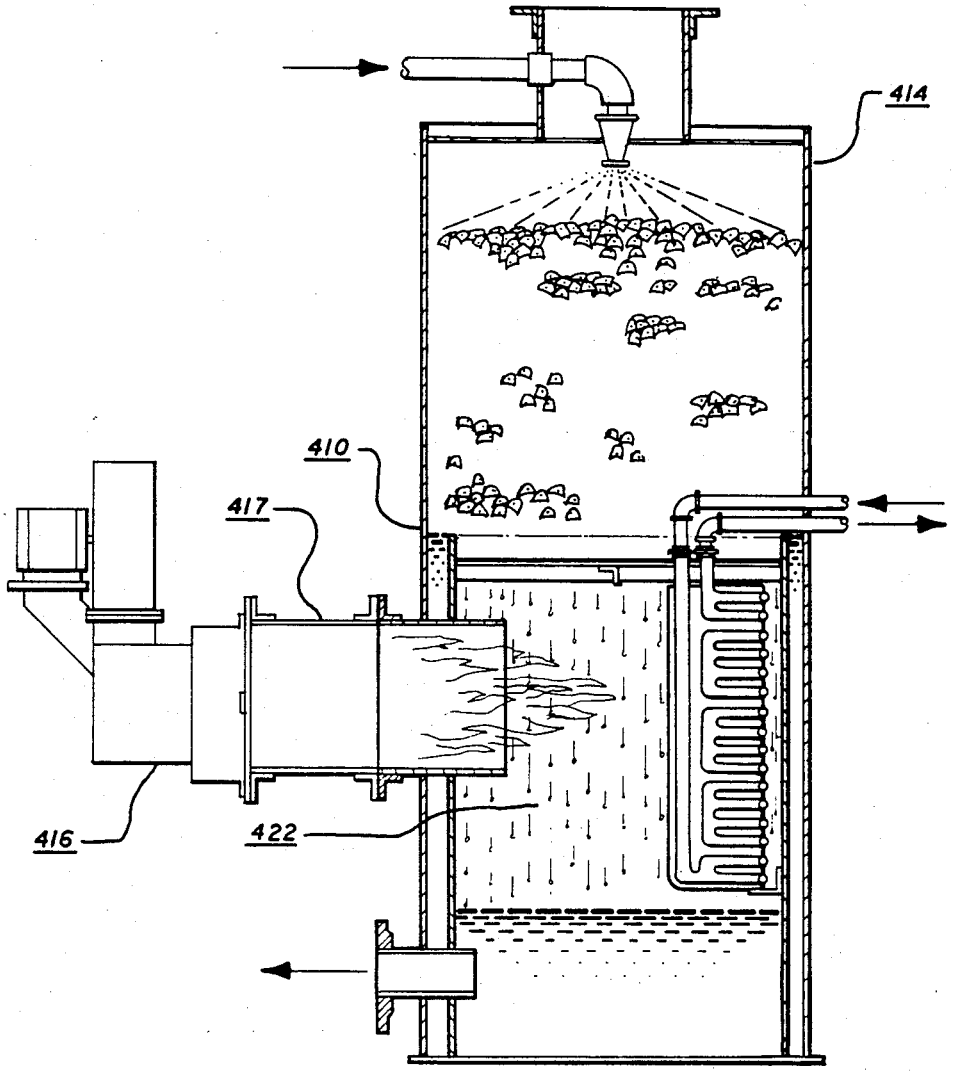
FIGS. 9, 10 and 11 are sectional views of the burner and a portion of the hot water heater shown in FIGS. 1 and 2 but with the gas jet burner of alternate designs.
Figure 10:
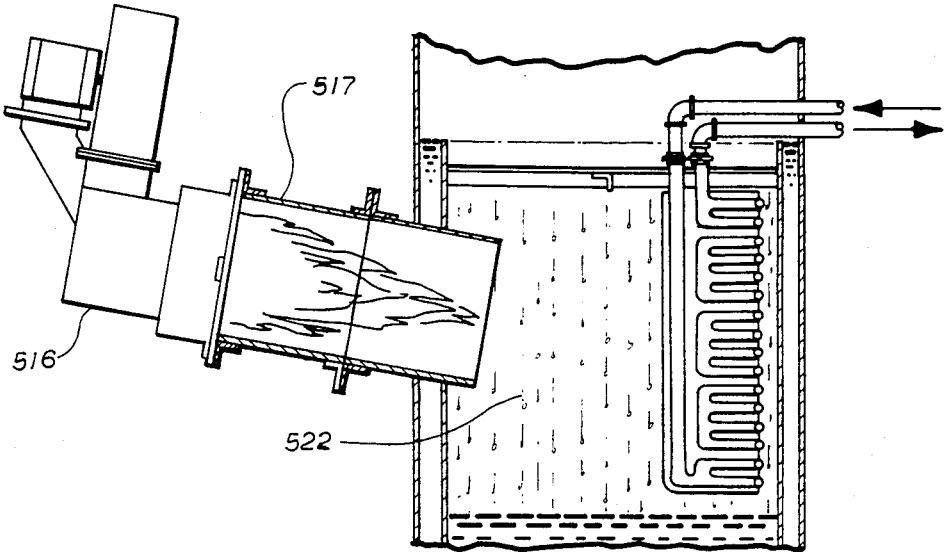
Figure 11:
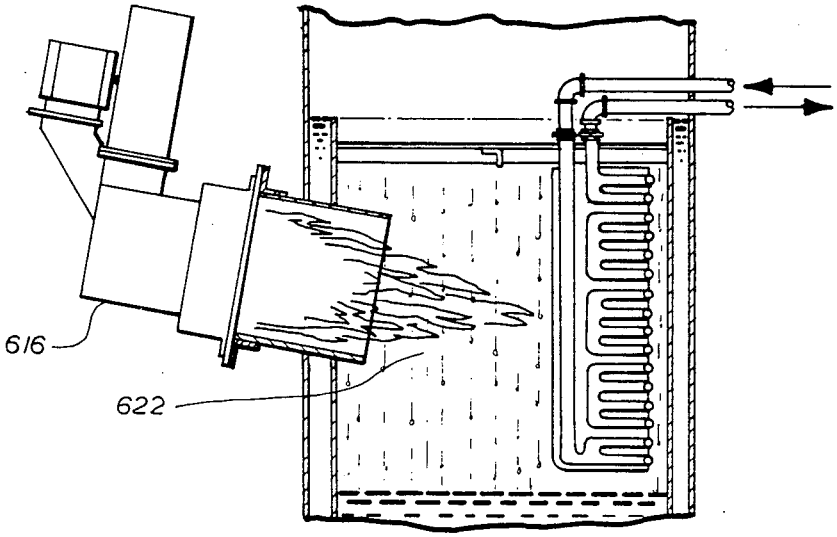

The present invention also includes further alternate embodiments as shown in FIGS. 9 and 10 and 11. The gas-jet burners 416 located in a recessed manner through an intermediate spacer sleeve 417. The flame is thereby recessed so that the flame itself does not directly enter the combustion zone 422 of the hot water heater 414. In this manner the thermal output of the gas jet heater which effects the heating of the water and the heat exchanger is the flue gasses heated by gas output of the gas jet rather than the flame of the gas jet itself.

The FIG. 10 embodiment illustrates the gas-jet burner 516 with intermediate spacer sleeve 517 as angled with respect to the radial direction of water moving through the combustion zone 522.

FIG. 11 illustrates an embodiment of the invention similar to that of FIG. 10. The gas jet burner 616 is angled as in FIG. 10 but the intermediate spacer sleeve is eliminated so that the flame extends into the combustion zone 622 as in the primary embodiment.

It should be understood that the present hot water heater is significantly more efficient than all known commercial hot water heaters. As a result, the quality of the water remains relatively pure through continued operational cycles with minimum scaling in combination with superior gas removal through the flue. As a result, the system as a total is more efficient due to the purity of the water being heated as well as being used during the heat exchanger functioning.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. An improved gas-jet hot water heater system for the generation of high-temperature water at atmospheric pressure simultaneous with superheated water and/or steam comprising:

a primary tank for the generation and storage of high-temperature water at atmospheric pressure including an upper preheat zone containing heat transfer bodies therein through which water to be heated may pass, an intermediate combustion zone located beneath the preheat zone having a gas-jet burner for the heating of water passing therethrough, and a storage zone located beneath the combustion zone for receipt of the heated water passing through the combustion zone;

a supplemental water-heating sub-assembly including a pressurized remote storage tank, a heat exchanger in the intermediate zone for water being heated by the products of combustion of the gas-jet burner, the gas jet burner positioned for generating hot gases for preheating water in the preheat zone, for heating water in the intermediate zone and for maintaining the heat in the water in the storage zone and, concurrently, for heating water in the supplemental water heating sub-assembly, and conduit means coupling the heat exchanger with the remote storage tank whereby t he heat exchanger will create superheated water and the remote storage tank will store the superheated water in its lower extent and create steam in its upper extent;

means for withdrawing superheated water from the lower extent of the remote storage tank; and means for withdrawing steam from the upper extent of the remote storage tank.

2. The apparatus as set forth in claim 1 wherein the heat exchanger is located in the combustion zone, on the side thereof remote from the gas-jet burner.

3. The apparatus as set forth in claim 2 wherein the flame of the gas-jet burner extends into the combustion zone in operative proximity with the heat exchanger.

4. The apparatus as set forth in claim 2 wherein the gas-jet burner is recessed from the combustion zone so that its flame is withdrawn from the flow of water passing through the combustion zone whereby the heat exchanger is heated by the flue gasses which are heated by the gas-jet burner.

5. An improved gas-jet hot water heater for the generation of heated water at atmospheric pressure simultaneously with superheated water and/or steam comprising:

a vessel for the generation and storage of heated water at atmospheric pressure, the vessel having a preheat zone with a spray nozzle for dividing a first cold water inlet stream into a plurality of cold water droplets for passage downwardly through a plurality of irregularly shaped passageways formed by the random contact with a plurality of heat exchanging bodies, the plurality of heat exchanging bodies disposed on a grid for supporting the collective weight of the plurality of heat exchanging bodies, the heat exchanging bodies being further disposed and oriented for thermal exchange between the plurality of cold water droplets passing downwardly and a stream of hot combustion gases ascending upwardly through the irregularly shaped passageways, the vessel further having an intermediate zone for combustion whereat the thermal output of a gas-jet burner may exchange its heat with the water passing therethrough from the preheat zone, and a lower zone having a reservoir for the receipt and storage of the heated water from the intermediate zone;

a semi-circular heat exchanger in the combustion zone for circulating water to be superheated by the thermal output of the gas-jet burner, the heat exchanger being mounted on the inner periphery of the intermediate zone and formed of two arcuate shaped plates having an alternating series of ridges and valleys which, when mated form a serpentine heat exchange passageway, the heat exchanger adapted to receive a second cold water stream and to discharge superheated water therefrom; and conduit means coupled to the heat exchanger for remote usage of the circulating superheated water as superheated water and/or as steam.

6. The apparatus as set forth in claim 5 wherein the heat exchanger is located on the side of the combustion zone remote from the gas-jet burner.

7. The apparatus as set forth in claim 6 wherein the flame on the gas-jet burner extends into the combustion zone in operative proximity with the heat exchanger.

8. The apparatus as set forth in claim 6 wherein the gas-jet burner is recessed from the combustion zone so that its flame is withdrawn from the flow of water through the combustion zone whereby the heat exchanger is heated by the flue gasses heated by the gas-jet burner.

9. The apparatus as set forth in claim 5 and further including a pressurized supplemental vessel for the receipt and storage of superheated water from the heat exchanger in the lower portion thereof and for the storage of steam in the upper portion thereof.

10. The apparatus as set forth in claim 9 and further including means to provide make up water to the supplemental vessel from the reservoir.

11. The apparatus as set forth in claim 9 and further including means to provide make up water to the supplemental vessel from a remote source.

12. The apparatus as set forth in claim 5 wherein the flame of the gas-jet burner is directed toward the combustion zone, perpendicularly with respect to the direction of movement of water through the combustion zone.

13. The apparatus as set forth in claim 5 wherein the flame of the gas-jet burner is directed toward the combustion zone at an angle with respect to the direction of movement of water through the combustion zone.

14. A method of generating hot water at atmospheric pressure in a hot water heater simultaneously with the generation of superheated water and/or steam comprising the steps of:

providing a primary water heater for the generation of hot water at atmospheric pressure the primary water heater having an upper preheat zone, an intermediate heating zone and a lower storage zone;

providing in the intermediate heating zone a supplemental water heating sub-assembly including an arcuate shaped heat exchanger having a serpentine-like path;

positioning in operative association with respect to the intermediate heating zone a gas-jet burner for generating hot gases for preheating the water in the preheat zone, for heating the water descending through the intermediate zone, and for maintaining the heat in the water in the storage zone concurrently with the heating of the water in the supplemental water heating sub-assembly; and coupling the heat exchanger in a system whereby water, superheated in the heat exchanger, may be fed for use as superheated water and/or steam.

* * * * *